US006479948B2

(12) United States Patent
Yamamoto et al.

(10) Patent No.: US 6,479,948 B2
(45) Date of Patent: Nov. 12, 2002

(54) STARTING DEVICE FOR DISCHARGE LAMP

(75) Inventors: Youichi Yamamoto, Tottori (JP); Osamu Miyata, Machida (JP); Hisao Hirata, Fujisawa (JP)

(73) Assignees: Hitachi Ferrite Electronics, Ltd. (JP); Stanley Electric Co., Ltd. (JP)

( * ) Notice: Subject to any disclaimer, the term of this patent is extended or adjusted under 35 U.S.C. 154(b) by 0 days.

(21) Appl. No.: 09/802,079

(22) Filed: Mar. 8, 2001

(65) Prior Publication Data

US 2001/0026132 A1 Oct. 4, 2001

(30) Foreign Application Priority Data

Mar. 10, 2000 (JP) ..... 2000-066433

(51) Int. Cl.[7] ..... H05B 37/00

(52) U.S. Cl. ..... 315/289; 315/376; 315/282; 315/DIG. 5; 336/107; 336/145; 336/182

(58) Field of Search ..... 315/77, 82, 56, 315/57, 289, 276, 282, 291, 85, DIG. 5; 336/82, 107, 145, 181, 182, 220; 361/600, 620, 623

(56) References Cited

U.S. PATENT DOCUMENTS 4,525,650 A * 6/1985 Hicks et al. ..... 315/219
5,959,407 A * 9/1999 Ito et al. ..... 315/276
5,959,521 A * 9/1999 Kohmura et al. ..... 336/192
6,040,659 A * 3/2000 Masuda et al. ..... 315/326
6,066,921 A * 5/2000 Nakamura et al. ..... 315/291
6,084,354 A * 7/2000 Kohmura et al. ..... 315/57

FOREIGN PATENT DOCUMENTS

JP 63228706 A * 9/1988 ..... H01F/40/00
JP 08130134 A * 5/1996 ..... H01F/36/00
JP 8-222380 8/1996
JP 10-35357 2/1998

* cited by examiner

*Primary Examiner*—Haissa Philogene
(74) *Attorney, Agent, or Firm*—Gifford, Krass, Groh, Sprinkle, Anderson & Citkowski, P.C.

(57) ABSTRACT

The objectives of the present invention is to provide smaller, lighter and less expensive structure in a starting device for discharge lamp for car use so as to prevent breakage due to vibrations etc. The device having the following arrangement realizes the above-mentioned objective. A starting device for a discharge lamp comprises a socket for mounting the discharge lamp and starting members such as a starting transformer etc. where the starting transformer comprises a bobbin having a core-less structure and a primary coil and a secondary coil wound around the bobbin.

6 Claims, 11 Drawing Sheets

$V_{O-P-}$ = 19.2kV, t – = 400nsec $V_{O-P-}$ = 18.4kV, t – = 200nsec

STARTING DEVICE FOR DISCHARGE LAMP

BACKGROUND OF THE INVENTION

1. Field of the Invention

The present invention relates to a starting device for discharge lamp, particularly suitable to a lamp lighting device for vehicle headlights.

2. Brief Description of the Prior Art

The Lamp lighting device for vehicle headlights having a starting transformer equipped with a core is now widely used. But in this starting transformer the core should be form voluminous in order to avoid an electric current saturation phenomenon that sometimes occurs in the starting transformer equipped with the above-mentioned core. In other words, inductance value in the ordinary transformer, usually equipped with the core, reaches a saturated value (corresponding to the inductance value of a coreless transformer), at a certain electric current value, as shown in FIG. 5 where inductance characteristic curves against electric current value are depicted.

Magnetic properties of the core are influenced by ambient temperature. FIG. 6 is a figure for determining Curie temperatures in the respective core types depicting relations between temperature T (° C.) and initial permeability ($\mu i$) values of A type (a broken line) and B type (a solid line) cores used at a relatively lower temperature (below 100° C.) and at a relatively higher temperature (below 150° C.) respectively.

The Curie temperature of A type is 174° C. for the lower temperature use and that of B type is 200° C. for the higher temperature use. Since a ferrite core has a critical temperature (Curie temperature) where the core transforms from ferromagnetic to paramagnetic, the ferrite core with the higher Curie temperature should be used at a higher temperature range (100° C.~200° C.).

When an HID lamp is employed as the discharge lamp, the core with Curie temperature above 200° C. should be selected for the starting transformer from a safety point, since heat from the lamp raises the temperature of the core up to ca. 150° C. due to a short distance between the lamp and the core when a starting circuit is arranged in a lamp socket. The higher Curie temperature of the core is, the lower the initial permeability ($\mu i$) of the core is (i.e. a lower inductance value when coil turns are kept constant), which means lower performance. Since such core is not usually employed, quantity of the commercially manufactured core is small, which naturally leads to a cost increase.

When ferrite type cores are molded by an epoxy resin etc. for insulation, fatal defects such as ruptures or cracks are sometimes formed due to a shrinkage difference between the core and the molded resin. In order to avoid the above-mentioned defects caused by the shrinkage of the molded resin, the core has to be closed in a bobbin etc. or the core with a simple shape (round or rectangular rod etc.) is required.

In the conventional starting device for discharge lamp with the above-mentioned core, a supporting point of the core was easily broken by vibrations and impacts etc. because of a core weight. As measures against such breakage a core supporting mechanism was reinforced or other supporting members were added. Which resulted in a manufacturing cost increase.

SUMMARY OF THE INVENTION

The present invention is carried out in view of the above-mentioned problems so as to provide a small sized and light weighed starting device for discharge lamp free from breakage due to vibrations and impacts, as well as the inexpensively arranged starting device.

The starting device for discharge lamp is constituted as follows:

(1) The starting device for discharge lamp equipped with a socket for mounting the discharge lamp and a starting device member; where the starting device has a starting transformer comprising a bobbin for mounting the starting transformer and a core-less coil structure consisting of a primary and a secondary coils wound around the bobbin.

(2) The starting device for discharge lamp according to (1) where the diameter of the core-less portion of the starting transformer is set between 0.1 mm to 10 mm and one end of the secondary coil is led through the core-less portion and electrically connected to a high voltage electrode.

(3) The starting device for discharge lamp according to (1) where the core-less portion of the starting transformer is formed in a column with a circular or rectangular cross section, coil winding portions of the bobbin are formed in circular shape for divided winding and aligned the same axis as the center of the socket.

(4) The starting device for discharge lamp according to one of the (1) to (3) where leading wires from respective coils of the starting transformer is fitted in notches formed on a hollow wall of a rear side of a socket case and fixed to the wall by clips.

(5) The starting device for discharge lamp according to (1) where the starting device has a harness equipped with a connector.

(6) The starting device for discharge lamp according to (1) where the starting device has a direct coupler.

BRIEF DESCRIPTION OF DRAWINGS

FIG. 1A is a front view. FIG. 1B is a side view.

FIG. 3A is a front view. FIG. 3B is a side view. FIG. 3C is a cross sectional view along B—B line of FIG. 3A. FIG. 3D is a rear view of the second embodiment with a rear socket cover removed

FIG. 8A shows a manner of the equal winding turns in each section of the bobbin. FIG. 8B shows a manner of decreased winding turns toward a high voltage side in the bobbin.

FIGS. 9A and 9B are the first and second equivalent circuits respectively.

FIG. 10A shows a curve of the present embodiments. FIG. 10B shows a curve of the conventional starting device.

FIGS. 11A to 11D show a first, a second, a third and a fourth methods respectively.

DETAILED DESCRIPTION OF THE PREFERRED EMBODIMENTS

Hereinafter detailed description of embodiments according to the present invention is explained by referring to FIG. 1A to FIG. 12.

The first embodiment according to the present invention shown in FIGS. 1A, 1B and FIGS. 2A, 2B is explained. This embodiment relates to a starting device for lamp lighting equipped in a lamp lighting device for an HID lamp. The lamp lighting device includes power sources for the HID lamp and for a trigger element to generate a starting pulse etc. equipped in a main body (not shown) of the lamp lighting device. The starting device for lamp lighting consists of structural members such as parts for starting and an HID lamp socket etc. The main body of the lamp lighting device and the starting device for lamp lighting is electrically connected between a connector 7 equipped to the starting device for lamp lighting via a harness 6 and a direct coupler equipped to the main body of the lightning device.

Figure 1A:
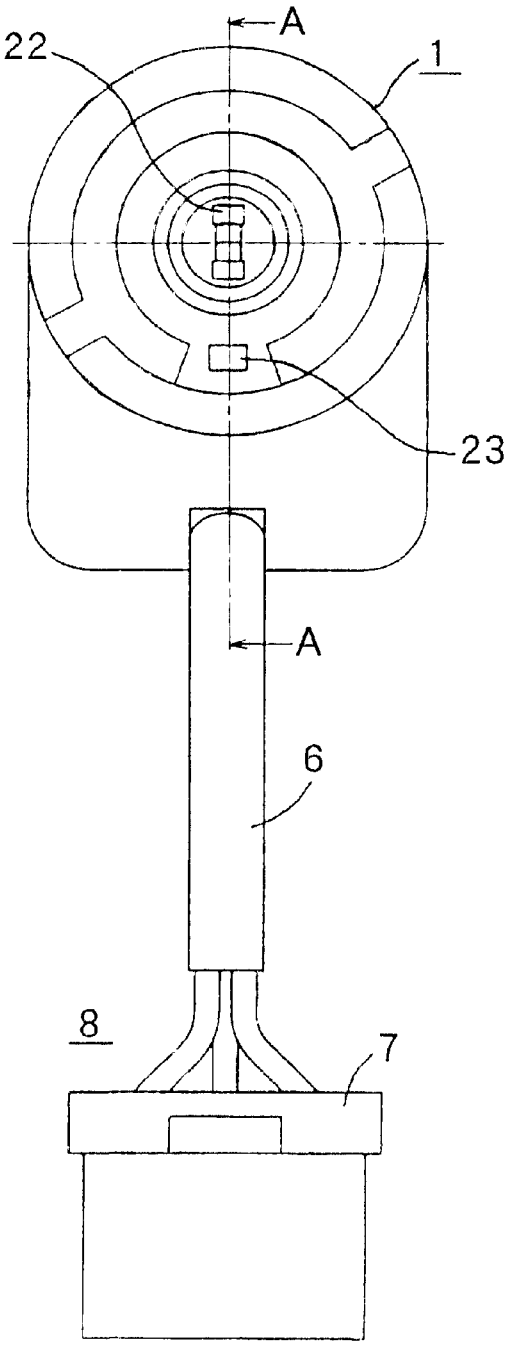
FIG. 1A and FIG. 1B show an arrangement of a first embodiment where a harness equipped with a connector is arranged according to the present invention.
Figure 1B:
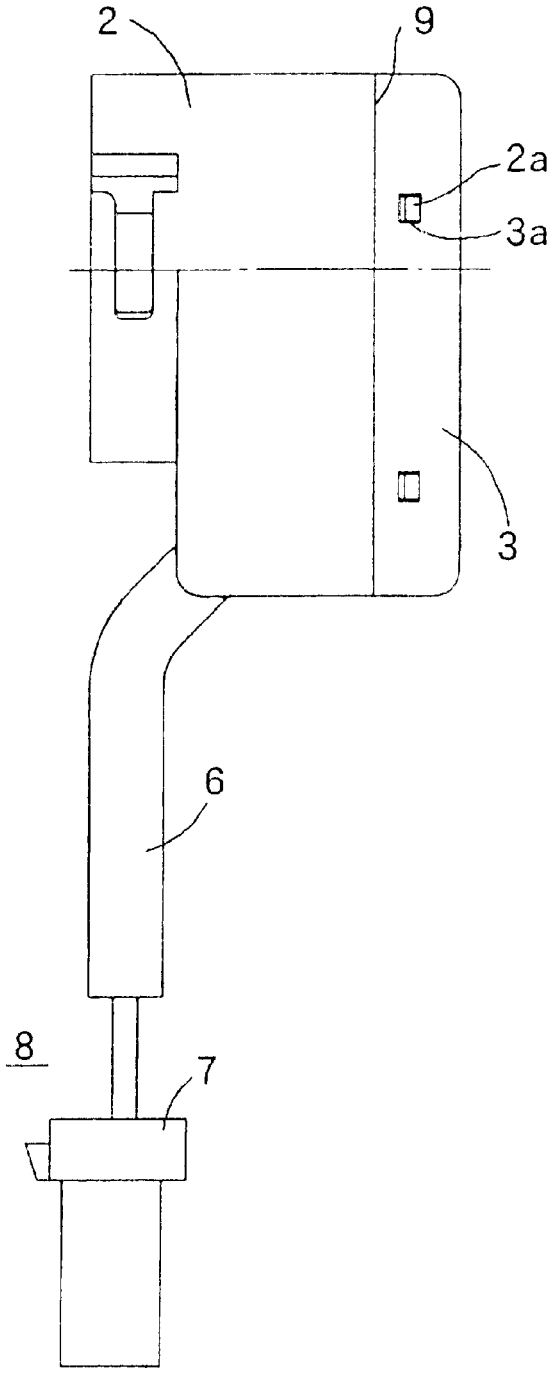

FIG. 1A is a front view of a starting device 1 for lamp lighting for car use where a front socket case 2, a left side portion of a parting line 9 (see FIG. 1B), has a high voltage electrode 22 and a GND (grounding) electrode 23 formed by an insert molding or a direct insertion. FIG. 1B is a side view illustrating how 7 protruded portions 2*a* (quantity varies case by case) formed on the socket case 2 are fitted in cutout openings 3*a* formed on a rear socket case 3.

Figure 2A:
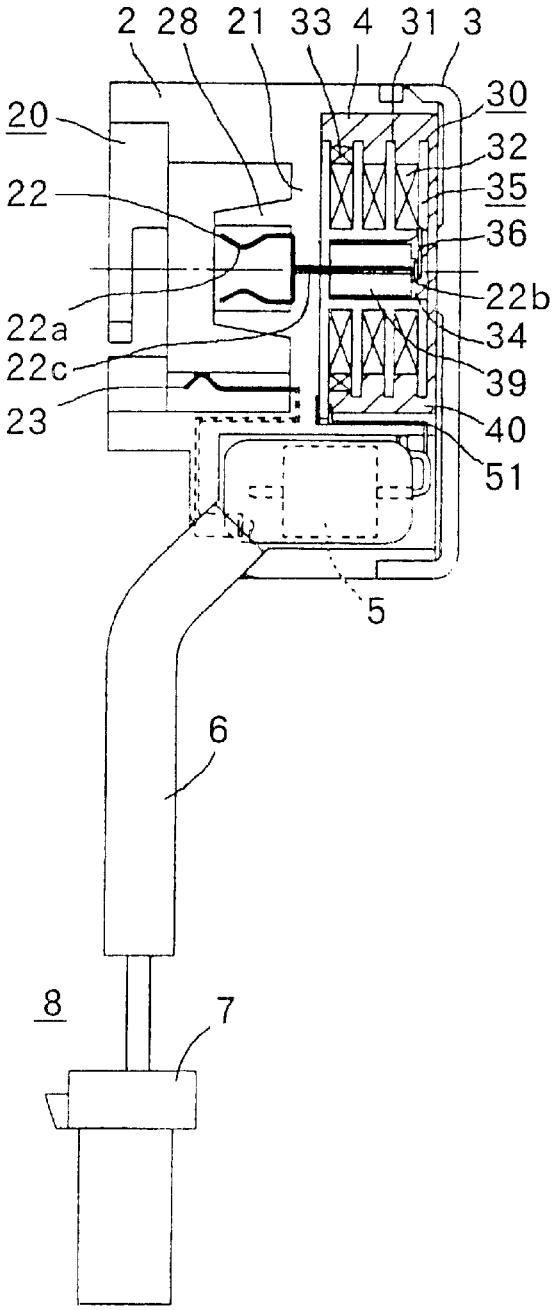
FIG. 2A is a cross sectional view along A—A line of FIG. 1A.

Hereinafter an inside of a socket 20 arranged in the above-mentioned way is explained by referring FIG. 2A, a cross sectional view of along A—A line in FIG. 1A, and FIG. 2B, a rear view with a socket case 3 removed. An insulating wall 28 is formed in the socket for insulating between the high voltage electrode 22 and the GND electrode 23, since a voltage between them reaches up to 20-odd kV. A high voltage leading electrode 22*c* led out from a high voltage lamp mounting electrodes 22*a* of the high voltage electrode 22 surrounded by the insulating wall 28, comprises a rear portion of the high voltage electrode 22. The high voltage leading electrode 22*c* has a circular cross sectional area with diameter of 0.1 to 10 mm or a corresponding square cross sectional area with diameter of 0.1 to 8 mm square, so as to withstand the maximum current 2.6 A for the HID lamp. The high voltage leading electrode 22*c* extends thorough a separating wall 21 of the socket to a starting transformer accommodating space 4, namely to a hollow space 34 (0.1 to 10 mm in diameter or a square having equivalent cross section so that the high voltage leading electrode 22*c* is accommodated). A leading wire 36 at a high voltage side of a secondary coil 32 (which is explained below) is connected to the high voltage electrode 22*b* at the starting transformer side.

Figure 8A:
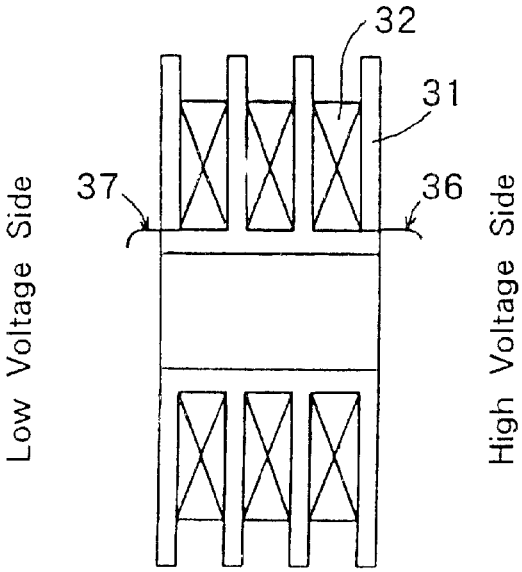
FIGS. 8A and 8B show winding manners in secondary coils.
Figure 8B:
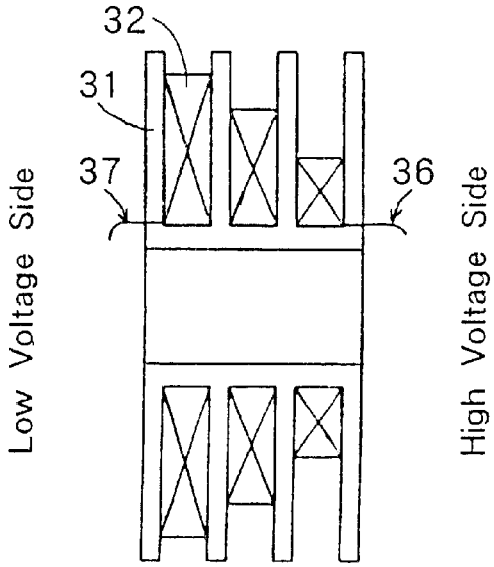
Figure 9A:
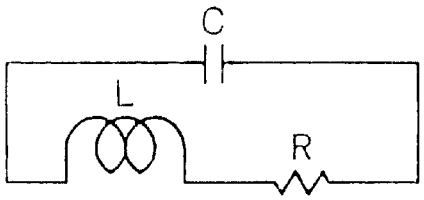
FIGS. 9A and 9B are equivalent circuits to secondary coil sides of the starting transformer.
Figure 9B:
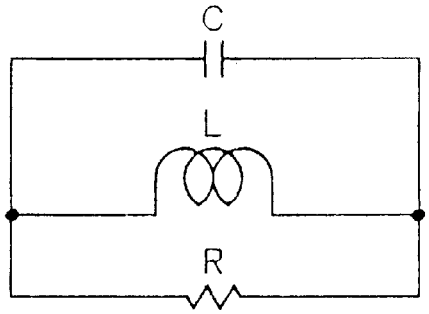

The secondary coil 32 (100 to 400 turns, with 0.1 to 1.0 mm wire in diameter, in experiments 300 turns and 0.3 mm in diameter are employed.) equipped in the starting transformer 30, is evenly wound around each winding section of a bobbin as shown in FIG. 8A or more turns at a low voltage side than a high voltage side as shown in FIG. 8B where insulating property is improved by gradated turns. The bobbin has a circular cross section in accordance with the geometry of the socket. A coil winding portion of the bobbin having a circular cross section is employed from a point of winding efficiency. The winding portion is divided into 3 to 6 sections. A distributed capacity of the secondary coil 32 is increased by divided turns explained above.

Figure 10A:
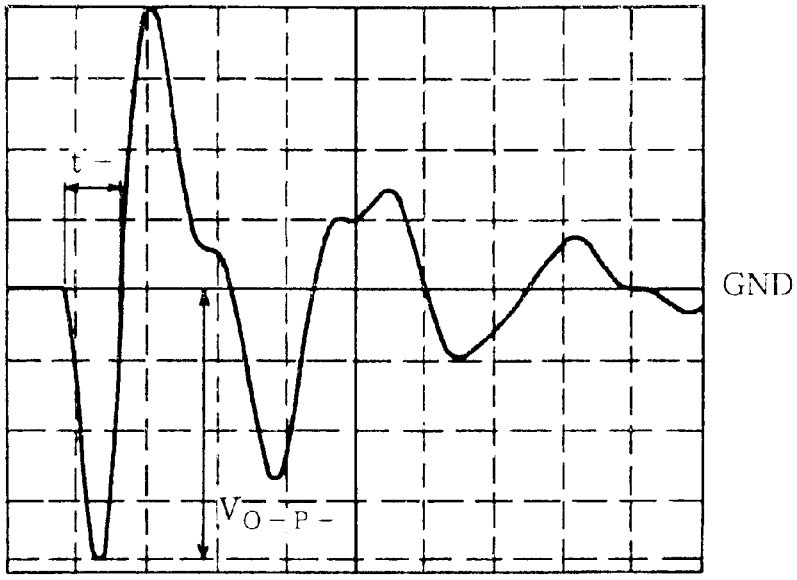
FIGS. 10A and 10B show transient curves of starting pulses.

The further apart from a magnetic center (in this case a winding center) the more increased the distributed capacity usually is. Distributed capacities in both equivalent circuits in FIGS. 9A and 9B to simulations in the experiment, where the secondary coil with 0.3 mm in diameter and 300 turns is employed, are ca. 3 pF. This capacity is a significant factor to increase a starting pulse. As shown in FIG. 10A a typical example of the increased starting pulse width attains a good vibration wave pattern in the experiments.

Figure 7:
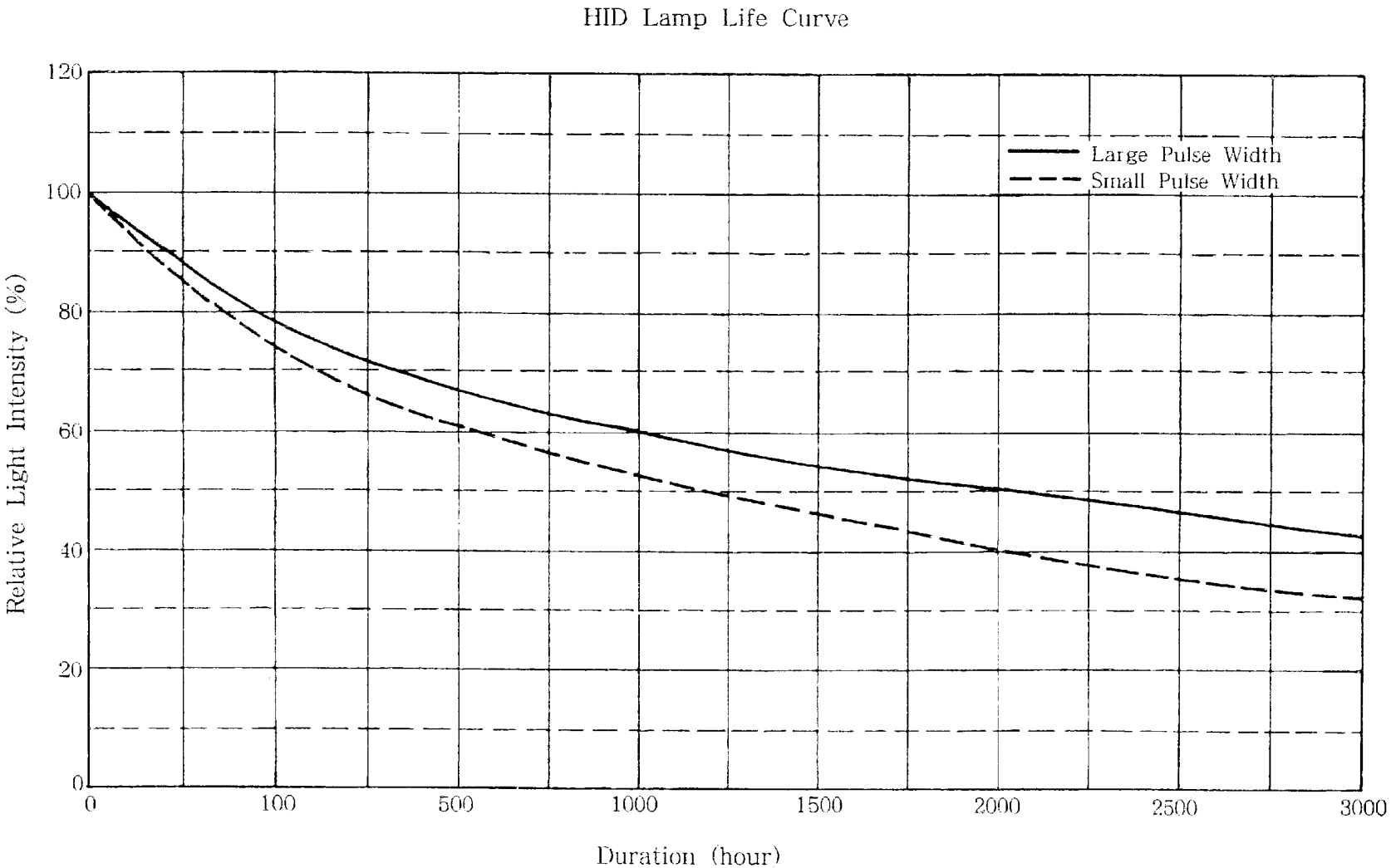
FIG. 7 depicts HID lamp intensity curves against duration in relation to pulse widths.

Our experiments proved that the distributed capacity is increased when more turns (overlapping turn) are formed at a narrow winding section so that the starting pulse width is increased, thus a life of an HID lamp is improved, since wearing a HID lamp electrode is suppressed as shown in FIG. 7. HID lamp life curves of a wide starting pulse width (0.4 msec) and of a narrow pulse width (0.2 msec) are plotted in FIG. 7 where an abscissa represents flashing duration of lamps and an ordinate represents relative light intensity. From this figure in case of the wide starting pulse width the light intensity seems to be deteriorated more slowly. A flushing mode of the lamp lighting device for car use in these experiments is as follows—after 5 cycles of ON (9 min. 45 sec.)/OFF (15 sec.) 10 min. OFF—. Since energy of the starting pulse (energy to start HID lamp) is usually determined by a product multiplied by the pulse width and a peak value of starting pulse voltage, the peak value can be decreased (to around limited value 20 kV) by increasing the pulse width. Namely, a boosted voltage ratio can be kept lower. As a result advantages such as a small sized transformer or an efficient transformer with less copper loss is obtained by decreased turning number in the secondary coil.

The distributed capacity of the secondary coil with one rowed nondivided turn is ca. 0.001 pF, on condition that the turning number is kept constant (a starting circuit constant is kept as the same value by employing a flat wire with layered winding due to a dimensional restriction of the bobbin). In case of this distributed capacity, the starting pulse width is ca. 0.2 $\mu$sec and shows a steep starting curve. (See FIGS. 10 and 10B.)

On the bobbin 31 a wire with a circular cross section is wound in stead of a wire with a rectangular cross section considering a winding efficiency. (The wire with the circular section has the lowest copper loss when a cross sectional area and the number of the turn are kept constant due to the fact that the outer diameter of the wire, namely, a length of the wound wire amounts to the shortest.) A width of each divided section of the bobbin 31 is set several (an integer) times of the outer diameter (0.5~5.0 mm) of the wire so as to attain the most efficient winding. A wall thickness between the sections is set 0.5 to 2.0 mm. The primary coil 33 (1 to 10 turns, 0.1 to 1.0 in diameter. In our experiments a 4 turned coil by a wire having 0.5 mm in diameter is employed.) is arranged at the low voltage section of the secondary coil 32 (See FIG. 11A) considering a voltage difference between the primary and secondary coils. However, when a wire with high insulating property (withstand voltage: 10 to 20 kV) such as a wire with three layered insulation is used for the primary coil 33, the wire should be wound in a central area of the bobbin where a connection between the primary and the secondary coils is most preferable. (See FIG. 11B. In this case since the bobbin is divided into three, the middle section is most preferable.) Alternatively, sections in the bobbin 31 with evenly wound coil (See FIG. 11C) can be employed when good connection is attained.

Figure 11A:
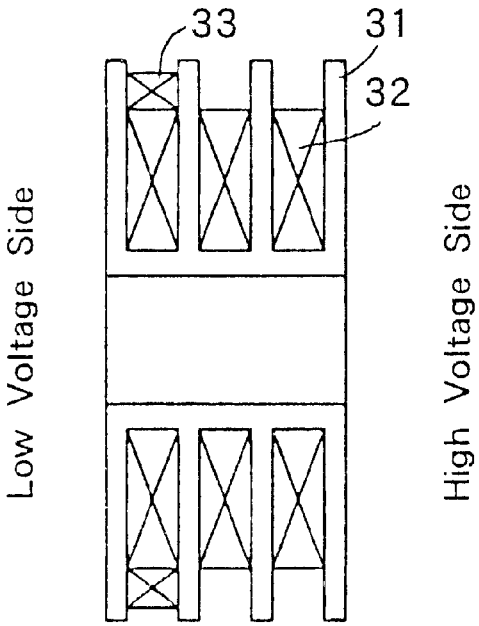
FIGS. 11A to 11D show winding manners in primary and secondary coils.
Figure 11B:
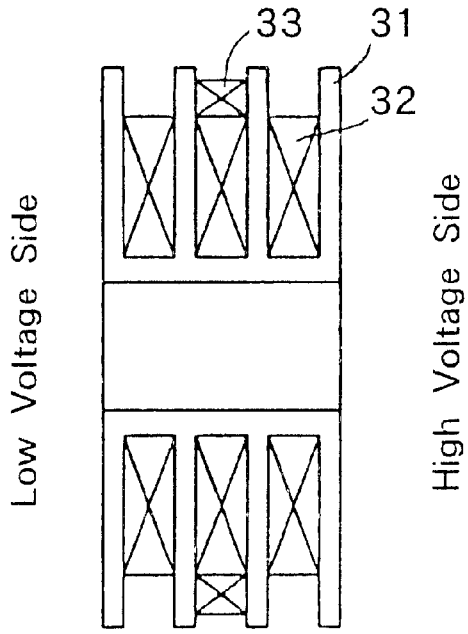
Figure 11C:
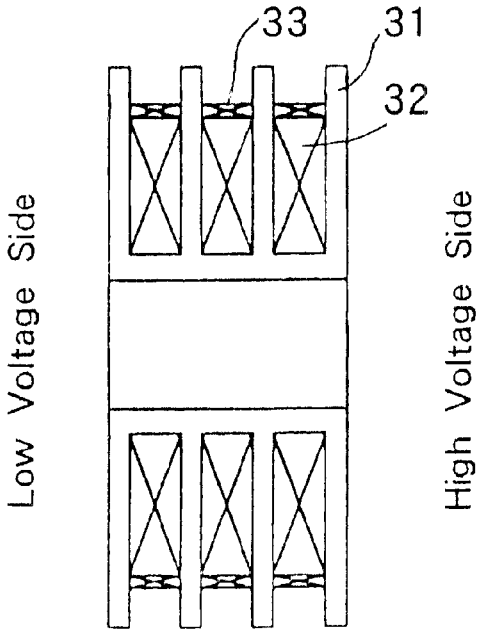
Figure 11D:
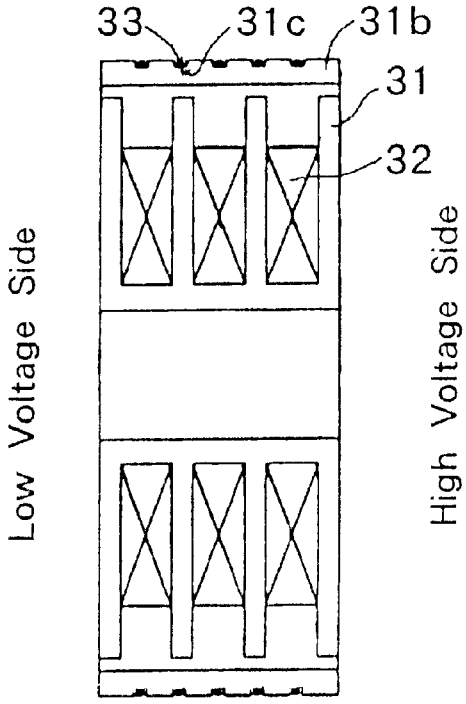

The another alternative shown in FIG. 11D is arranged as follows: A bobbin case 31*b* is used as an insulating wall for preventing a leakage between the primary and secondary coils. On the primary coil a wire with a circular or rectangular cross-section is uniformly and sparsely wound around the outer diameter of the bobbin case 31*b*. Alternatively the wire is wound densely on the center section of the bobbin case 31*b*. On the bobbin case a groove 31*c* is formed spirally on the outer surface of the bobbin case 31*b* so as to ensure firm winding of the coil.

Figure 2B:
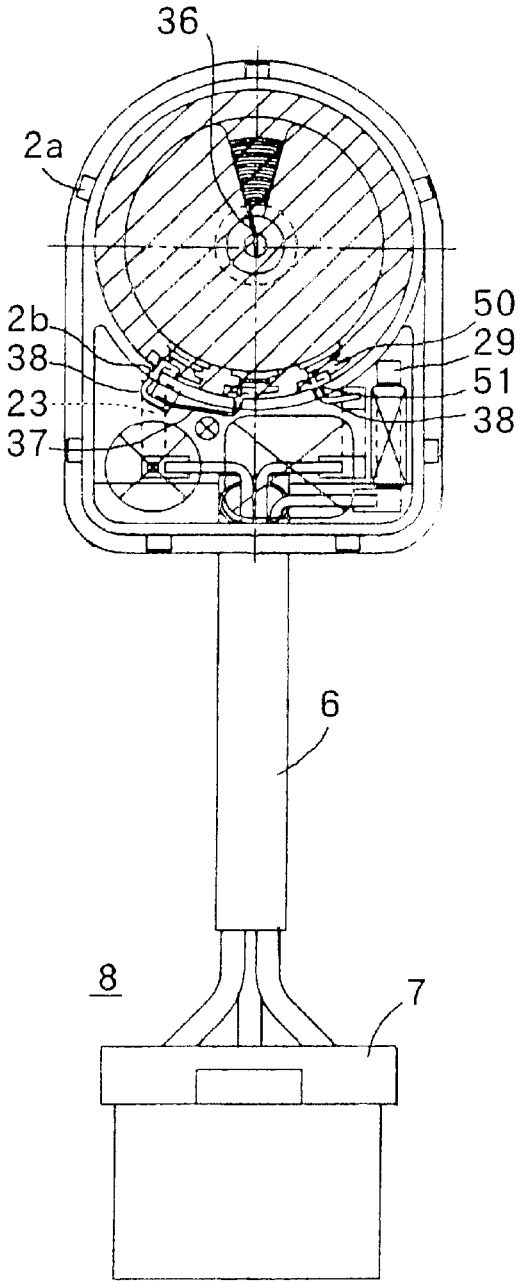
FIG. 2B is a rear view of the first embodiment with a rear socket cover removed.
Figure 3A:
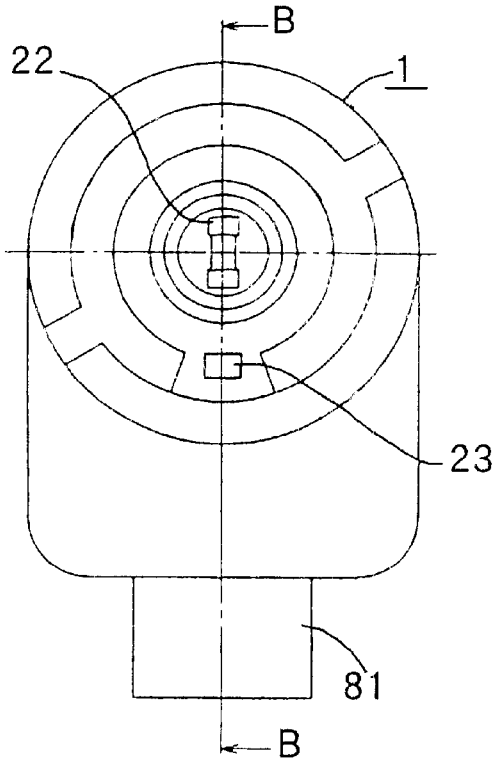
FIG. 3A to FIG. 3D show an arrangement of a second embodiment where a direct coupler is arranged according to the present invention.
Figure 3B:
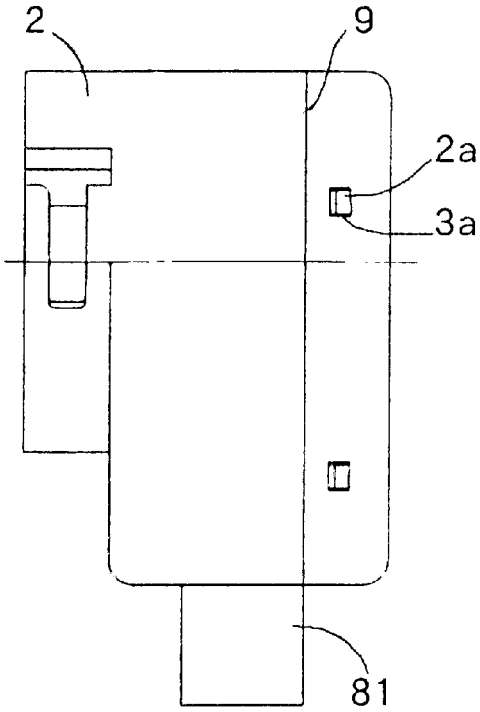
Figure 3C:
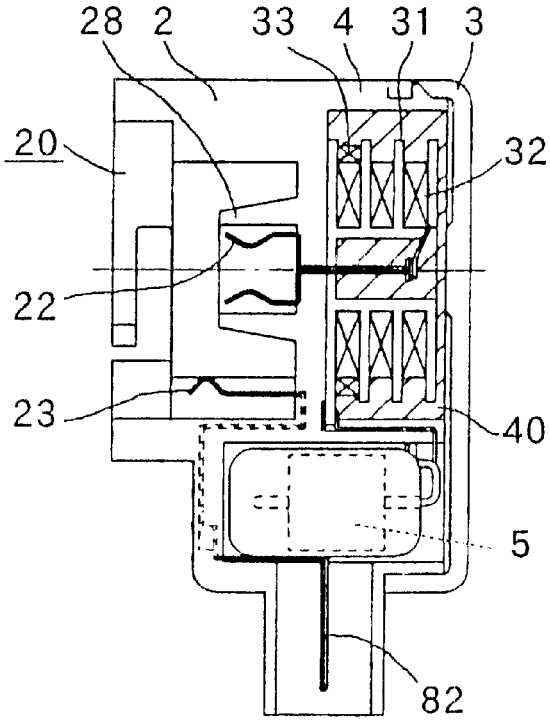
Figure 3D:
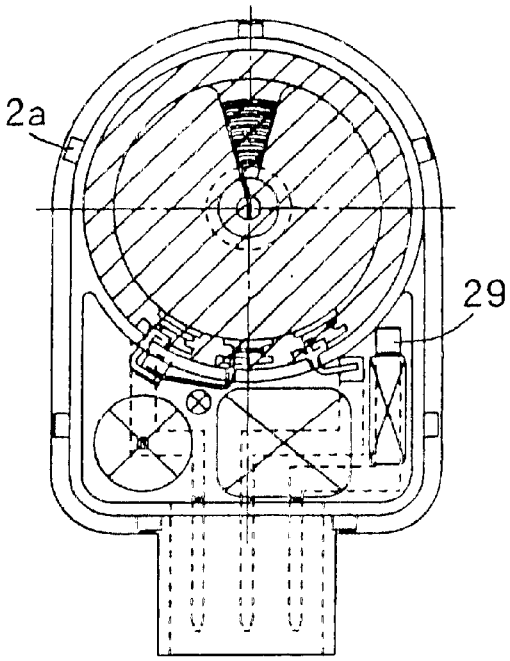

As shown in FIG. 2B a leading wire 37 at a lower voltage side of the secondary coil 32 and two leading wires 38 of the primary coil 33 are connected to three leading wire connecting points 50 (quantity is adjustable) formed on the bobbin 31. And these leading wires are lead to starting device member accommodating compartment 5 for the starting device via three slits 2*b* (quantity is adjustable) so as to trail on the side wall of a starting transformer accommodating compartment 4. Parts for a starting circuit accommodated in the starting device member accommodating compartment 5 for the starting device are connected to a connecting board 29 connected to the starting transformer and a harness assembly 8, by welding or high temperature soldering. (Since this portion is located near the HID lamp so that the ambient temperature reaches ca. 150° C., a low temperature solder usually employed in organic circuit boards is not suitable.)

The leading wires 37 and 38 are contacted with the starting transformer accommodating compartment 4 closely via a clip 51 in order to avoid these leading wires from contacting the coil 35 (particularly the secondary coil 32, to ensure insulation).

After accommodating the starting transformer 30 in the accommodating compartment 4, only the starting transformer 30 is molded with a molding material. (an epoxy resin, a urethane resin, a silicon resin and the like) The insulation is easily attained by the molding material 40 which is flown into the inside of the core-less structure 34. It is also possible to keep the diameter of the core-less structure 34 minimum for leading the high voltage electrode 22*b* at the starting transformer side but for ensuring enough insulation. In some cases the starting device member accommodating compartment 5 for starting device is molded after arranging parts for the starting circuit in it for ensuring insulation, protection against humidity and vibration and a stable fixture of parts The GND electrode 23 is connected to the parts accommodating compartment 5 for the starting device via inner portion of a separating wall 21 of the socket (see FIG. 2A), and finally it is connected to the harness assembly 8, which leads to the main body of the starting apparatus via the inputting connector 7.

Hereinafter the second embodiment shown in FIGS. 3A to 3D is explained. An electrical connection between the main body of the starting device and starting device for lamp lighting is attained by connecting a direct coupler 81 equipped on the main body of the starting device to a direct coupler 81 equipped on the starting device for lamp lighting, via a harness having a connector (not shown). Input terminals 82 (3 terminals +400V, −600V and GND in FIG. 4) equipped in the direct coupler 81 are metal electrodes formed in one-pieced member (formed in the socket case 2 or 3 by an insert molding) combined with a HID-GND electrode and an electrode 23 at a low voltage side of the secondary coil 32 or formed in separated members. Since only this forming method of the metal electrodes is different from that of the preceding embodiment 1, further detailed explanation is omitted.

Figure 4:
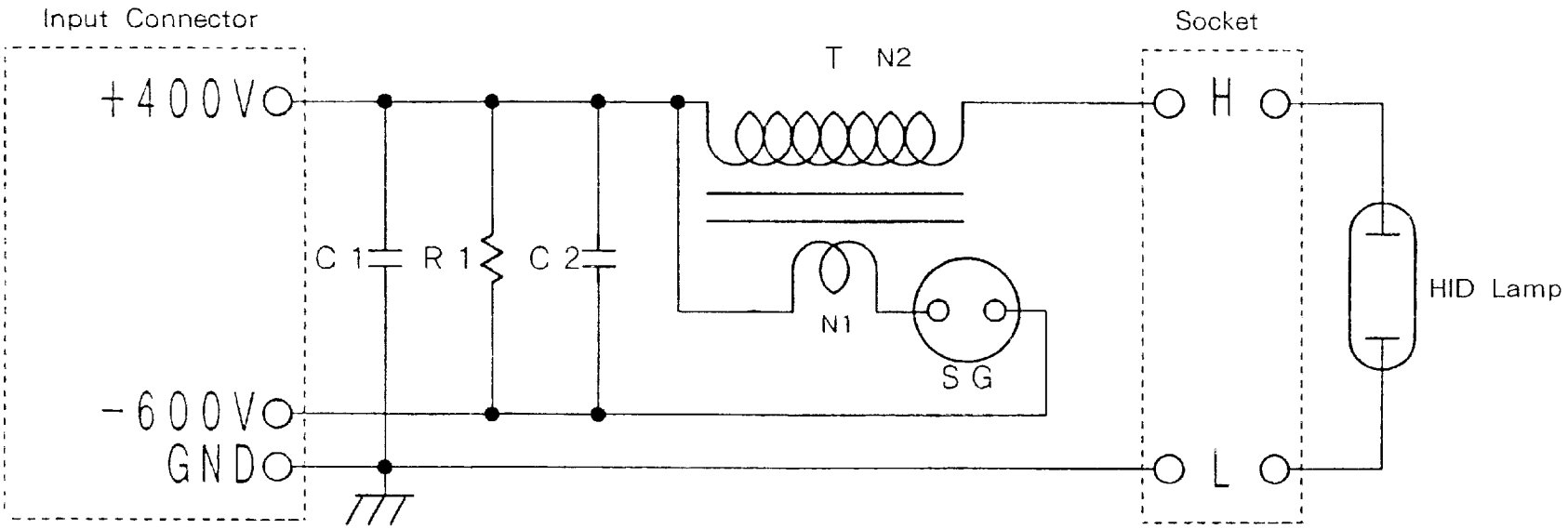
FIG. 4 shows a starting circuit diagram.

Hereinafter a starting lamp circuit depicted in FIG. 4 is described. Input powers supplied from the main body of the starting device (not shown in the figure) are +400V, GND as main powers and −600V as a power for SG (spark gap), a trigger element for high voltage pulse. In these embodiments the SG having a break down point of 800V is selected among SGs for car use having the break down points between 400V and 3 kV. The power −600V is supplied to the starting device circuit via resistance (not shown) connected in series to the output terminal. A constant determining a pulse cycle (usually between 30 to 150 Hz) is determined by applying 1 kV (voltage between the two terminals −600V and 400V) to a circuit where the above-mentioned resistance (not shown) and a charging/discharging capacitor C2 are connected in series.

When a voltage in the capacitor C2 reaches the break down point (In case of the SG of 800V the value is 800V +/−15%.) a electric current starts to flow in a primary coil N1 of the starting transformer T, which induces a high voltage in a secondary coil N2. The induced high voltage generates a starting pulse (ca. 25 kV) at the power +400V, as a result the HID lamp is activated. In the figure C1 is a capacitor used as a filter for the input powers and R1 is a resistance for discharging electric charge stored in the capacitor C2.

Figure 5:
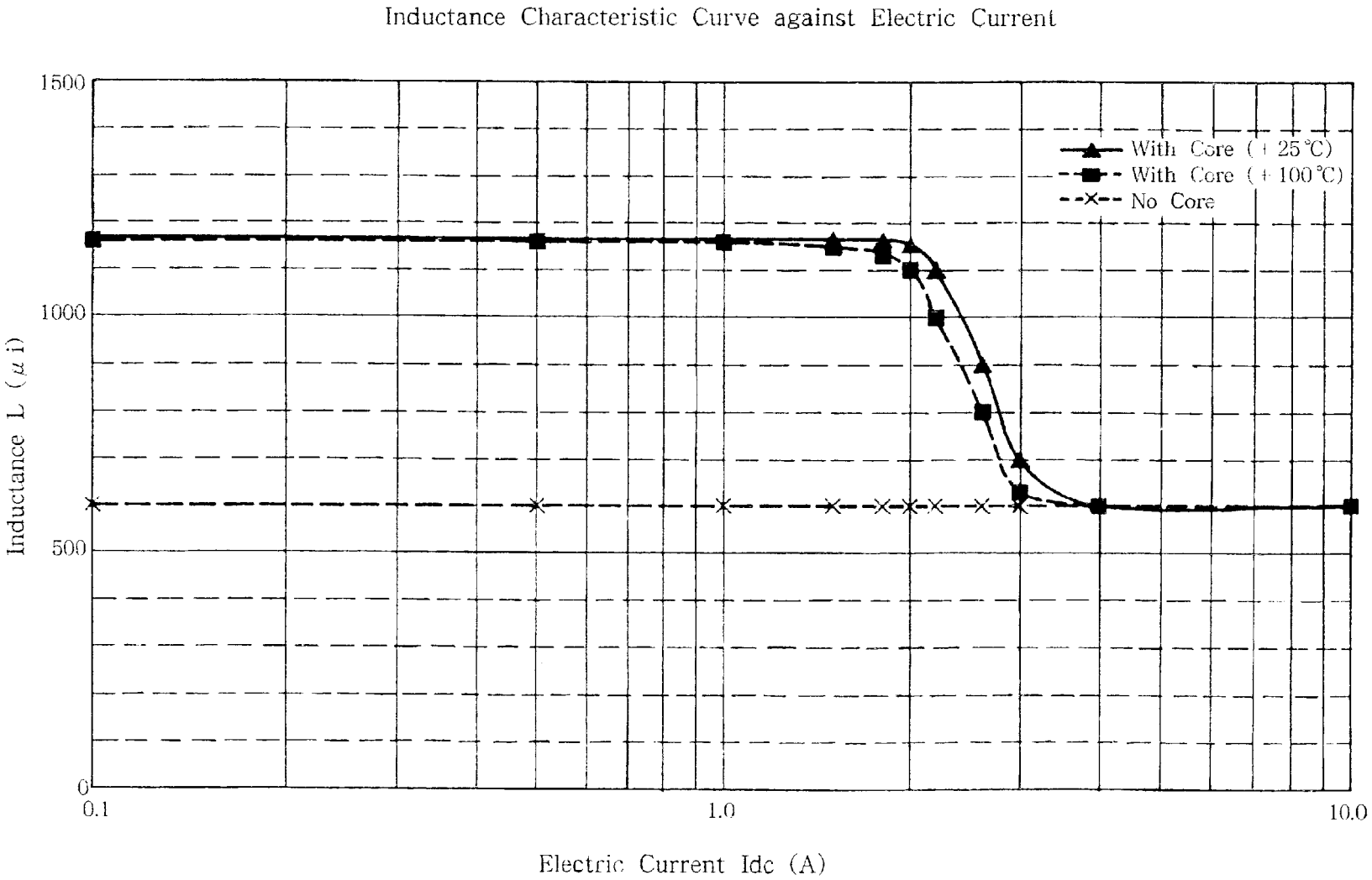
FIG. 5 depicts inductance characteristic curves against electric current of starting transformers with/without core.

Hereinafter inductance characteristics of coils with core or without core are explained. FIG. 5. The figure where an abscissa is electric current scale and an ordinate is inductance scale, shows that in coils with core inductance value start decreasing from a certain electric current value (in this case 2.0 A) and finally reach a constant value (saturated phenomena), in accordance with increasing electric current. When the ambient temperature is raised (+100° C.) the inductance value reaches the saturated phenomenon at a lower electric current value than that of the ordinary temperature (+25° C.). However in case of a coil without core the inductance keeps a constant value independent from changes of the electric current value and the ambient temperature.

Figure 6:
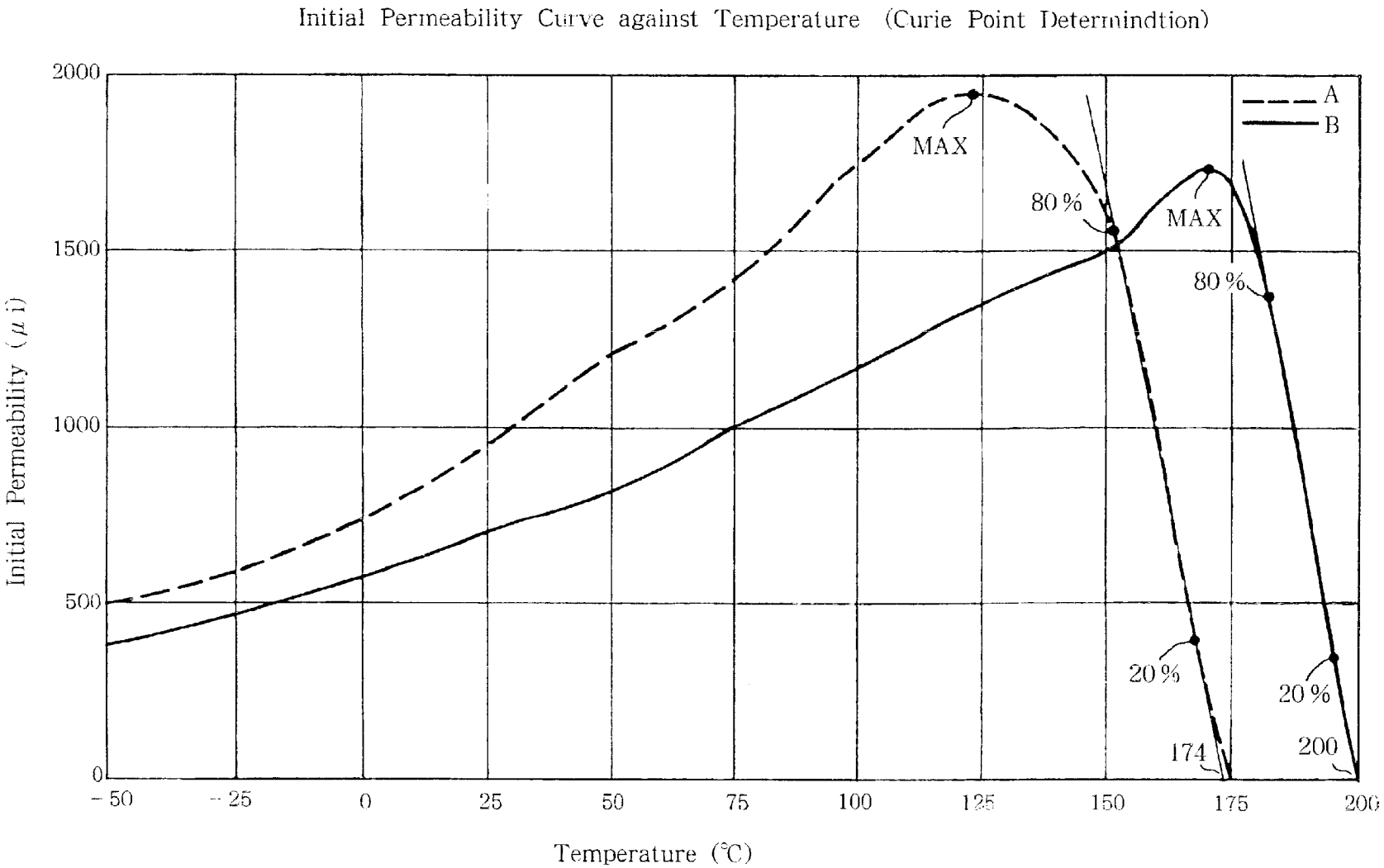
FIG. 6 depicts initial permeability curves of ferrite cores against temperature (Curie point determination curve).

In FIG. 6 initial permeability curves of cores against temperature for determining Curie point are plotted. Ni-ferrite cores are employed in both cores. The Curie point means a critical temperature where a magnetic property of a core changes from ferromagnetic to paramagnetic. Practically the Curie point is determined as follows: On a declining portion of the initial permeability ($\mu i$) curve against increasing temperature, two points, 80% and 20% of the maximum initial permeability, are determined and a line determined by the above-mentioned two points is extrapolated up to a point where $\mu i$=1.0, a temperature value at this point is defined as the Curie point.

By the above-mentioned method the Curie point of the A type core is determined 174° C. and that of the B type core is determined 200° C. Considering that the core is employed for car use and is equipped near the HID lamp, a core with higher Curie point is favorable, but $\mu i$ reciprocally decreases against the increased as shown in FIG. 6. In other words a coil with more turns are needed to obtain a required inductance value when a core with higher Curie point is used. The coil occupies more space and results in a larger sized starting device. In addition a resistance value in the coil is increased so that a power loss due to the increased resistance value is added to the circuit where the secondary coil N2 of the transformer T is directly connected to the power line +400V as shown in FIG. 4. Which results in decreasing the efficiency of the starting circuit. Since the cores with high Curie points are circulated not so many in the market and usually are not used, these cores requires higher production cost. The coil with core-less structure employed in the present invention solves above-mentioned problems.

Figure 10B:
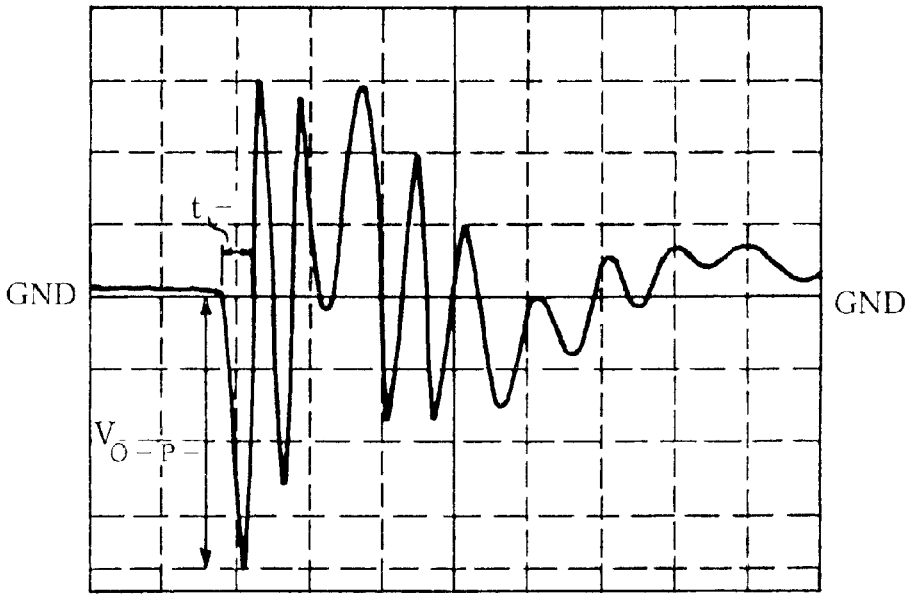
FIG.10B (PRIOR ART)
Figure 12:
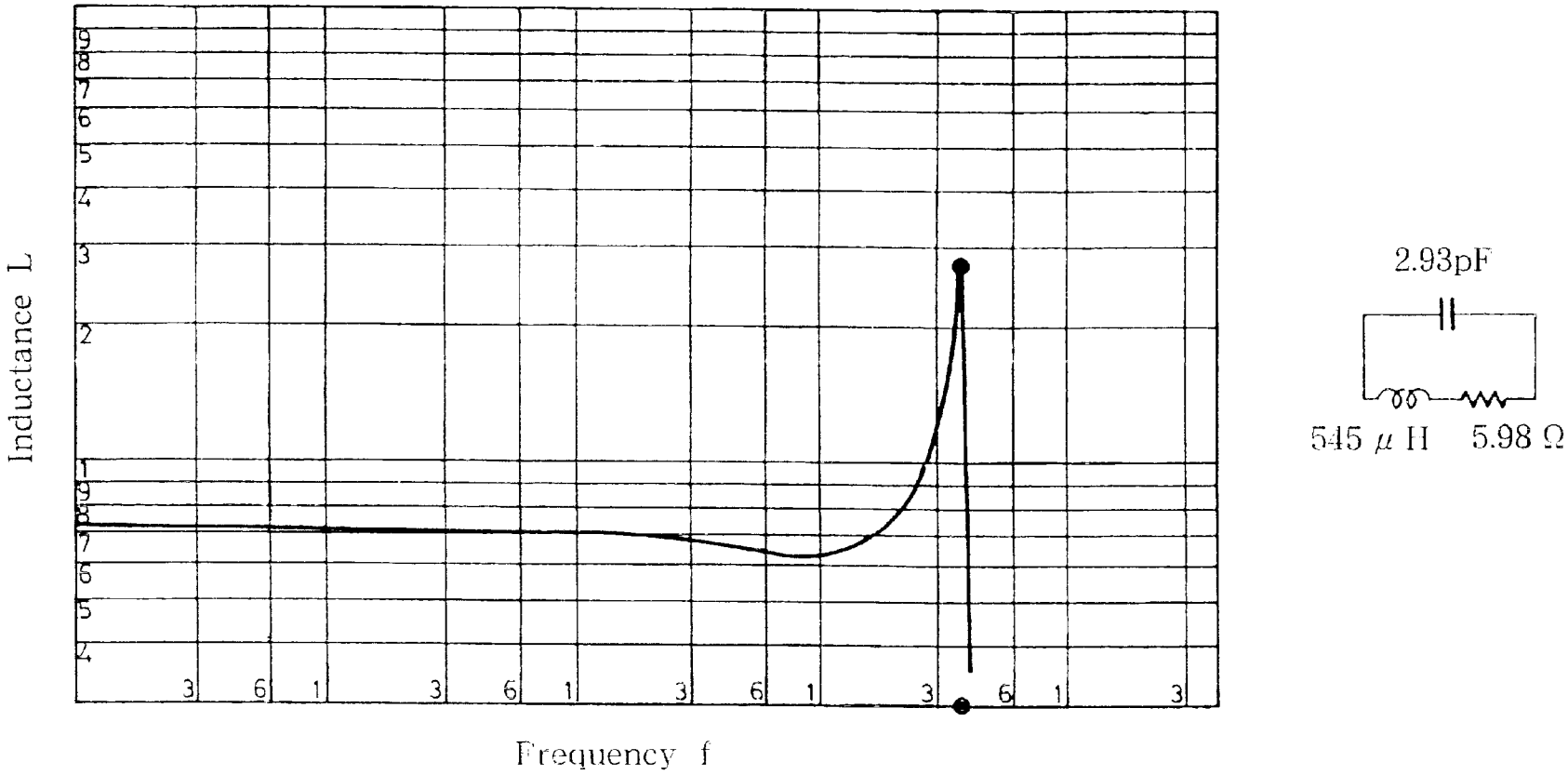
FIG. 12 depicts a resonance frequency of the secondary coil side of the starting transformer.

FIG. 12 shows a characteristic of resonance frequency (f–L) of the secondary coil of the starting transformer. In this ease the characteristic of the transformer having core-less structure 5 mm in diameter is depicted where the resonance frequency fc=3.785 Hz when the inductance value of the secondary coil Ls=0.6 mH. A circuit depicted on the left side of FIG. 12 is an equivalent circuit by a simulation where values except L (inductance value) are calculated. One cycle of the starting pulse is determined by the resonance frequency fc, i.e. 1/fc=0.264 μsec. The width of the starting pulse defined as a half of one cycle, is therefore 0.13 μsec. (Since the pulse width of the present invention is 0.4 μsec which is the approximately same value with the half value of one cycle, the wave in FIG. 10A shows rather clear oscillating wave pattern. When the distributing capacity value, ca. 3 pF in the secondary coil with 0.3 mm in diameter and 300 turns used in the experiment is lower than the simulated value (in case of aligned winding but not divided winding), the resonance frequency fc is higher than the above-referred value, consequently the width of the starting pulse is decreased. (As shown in FIG. 10B the starting pulse in the conventional starting transformer shows narrow in its width and more deteriorated wave pattern.) Which leads to reducing a service life of the HID lamp as described above.

HID lamp life curves of a wide starting pulse width (0.4 msec) and of a narrow pulse width (0.2 msec) are plotted in FIG. 7 where an abscissa represents flashing duration of lamps and an ordinate represents relative light intensity. From this figure in case of the wide starting pulse width the light intensity seems to be deteriorated more slowly. A flushing mode of the lamp lighting device for car use in these experiments is as follows—after 5 cycles of ON (9 min. 45 sec.)/OFF (15 sec.) 10 min. OFF—.

As explained above, since the core-less structure according to the present invention has no electric current saturation and is not influenced by the ambient temperature, a smaller and lighter device can be realized. As a result the following advantages are attained in producing the starting device for lamp lighting and its components. (a) Breakage of the device caused by vibrations and impacts etc. is prevented by arranging the starting transformer on the same central axis of the socket. (b) Life of the HID lamp is prolonged by employing divided winding around the bobbin of the transformer for increasing the distributed capacity. (c) The device can be fitted to every type of cars by attaining various connecting methods between the main body of the lamp lighting device and the starting device for lamp lighting.

In other words the following effects are attained in each component of the device.

(1) Core-less Coil Structure

No electric current saturation (In the transformer with core the inductance value is saturated from a certain electric current value.)

Independent from the ambient temperature (In the transformer with core the inductance value at higher temperature, ca. 100° C., is saturated at lower electric current value. A magnetic substance having the Curie point is never used at higher temperature than the Curie point.)

Efficiency of the starting circuit can be increased due to the reduced resistance value of the secondary coil attained by the bobbin with smaller diameter.

The core-less space at the center of the coil enables the socket case and the coil to be aligned on the same center axis. Which results in an easy connection between the output leading wire on high voltage side of the coil and the socket terminal arranged on the opposite side. And an excellent insulation is realized by casting the molding resin material into the core-less space.

A small sized device can be obtained, and material & assembly cost and weight can be also reduced.

(2) Alignment of the Transformer at the Center of the Socket

Since the transformer, the heaviest component in the device, can be arranged at the center of the discharging lamp, a good weight balance of the device is attained. Smaller sized device can be obtained by arranging the transformer at the center of the socket.

(3) Divided Coil Winding Around the Bobbin of the Starting Transformer

The wider width of the outputting pulse is obtained by the divided winding resulting in the higher distribution capacity (several hundred times to several thousand times) among wires in the secondary coil. Which results in relieving a stress imposed on the lamp electrode, reducing wear of the electrode and further prolonging the lamp life.

(4) Connection Between the Main Body of the Device and Lamp Lighting Device

By employing the harness equipped with the connector, coupler (connector) portion of the harness can be formed smaller then the direct coupler method. In some direct coupler methods, since a length of the harness equipped with the connector is adjustable to desired length, it can be easily applied to different types of cars.

What is claimed is:

1. A starting device for a discharge lamp comprising:

a socket for mounting said discharge lamp and a starting device member, wherein said starting device member has a starting transformer comprising:

a bobbin, a core-less coil structure formed by a primary coil and a secondary coil wound around said bobbin.

2. The starting device for the discharge lamp according to claim 1, wherein said device has a harness with a connector.

3. The starting device for the discharge lamp according to claim 1, wherein said device has a direct coupler.

4. A starting device for a discharge lamp comprising:

a socket for mounting said discharge lamp and a starting device member, wherein said starting device member has a starting transformer comprising:

a bobbin, a core-less coil structure formed by a primary coil and a secondary coil wound around said bobbin, wherein a diameter of said core-less coil structure is set between 0.1 mm and 10 mm, and one end of said secondary coil is led through a hole in said core-less coil structure and electrically connected to a high voltage electrode of said socket.

5. A starting device for a discharge lamp comprising:

a socket for mounting said discharge lamp and a starting device member, wherein said starting device member has a starting transformer comprising:

a bobbin, a core-less structure formed by a primary coil and a secondary coil wound around said bobbin, wherein said core-less structure of said starting transformer is formed in a column shape with a circular or a rectangular cross section, coil winding portions of said bobbin are formed circular and divided for dividing winding, and said starting transformer is aligned on the same axis as the center of said socket.

6. A starting device for a discharge lamp comprising:

a socket for mounting said discharge lamp and a starting device member, wherein said starting device member has a starting transformer comprising:

a bobbin, a core-less structure formed by a primary coil and a secondary coil wound around said bobbin, wherein leading wires from respective coils of said starting transformer are fitted in notches formed on a hollow wall of a rear side of a socket case and fixed to said wall by clips.

* * * * *